US005315928A

United States Patent [19]

Bocinski et al.

[11] Patent Number: 5,315,928

[45] Date of Patent: May 31, 1994

[54] BAND LINE PRINTER WITH GROOVED PLATEN

[75] Inventors: D. Michael Bocinski, Binghamton; Craig A. Kaufman, Apalachin; Randy J. Kisacky, Johnson City; Barton H. Kunz, Owego, all of N.Y.; Lawrence A. Stone, Cary, N.C.; Jerry Z. Raski, Endicott, N.Y.; David B. Schaefer, Apalachin, N.Y.; Douglas A. Schmidt, Owego, N.Y.

[73] Assignee: International Business Machines Corporation, Armonk, N.Y.

[21] Appl. No.: 979,707

[22] Filed: Nov. 20, 1992

Related U.S. Application Data

[63] Continuation-in-part of Ser. No. 664,254, Mar. 4, 1991, Pat. No. 5,168,803.

[51] Int. Cl.[5] ..... B41J 11/08

[52] U.S. Cl. ..... 101/93.14; 400/146; 400/656; 400/662

[58] Field of Search ..... 101/93.13, 93.14, 111; 400/23, 48, 146, 656, 662

[56] References Cited

U.S. PATENT DOCUMENTS

| | | | |
|---|---|---|---|
| 4,211,166 | 7/1980 | Hardt | 101/93.14 |
| 4,301,725 | 11/1981 | Hiki et al. | 101/93.14 |
| 4,489,650 | 12/1984 | Hasler et al. | 101/93.14 |
| 4,510,862 | 4/1985 | Alt et al. | 101/93.14 |
| 4,540,296 | 9/1985 | Thorne | 400/146 |

FOREIGN PATENT DOCUMENTS

| | | | |
|---|---|---|---|
| 2753132 | 5/1979 | Fed. Rep. of Germany | 400/656 |
| 2827895 | 5/1980 | Fed. Rep. of Germany | 400/656 |
| 55872 | 4/1980 | Japan | 101/93.14 |
| 38284 | 4/1981 | Japan | 400/146 |
| 67261 | 6/1981 | Japan | 101/93.14 |
| 67262 | 6/1981 | Japan | 101/93.14 |
| 101858 | 8/1981 | Japan | 400/656 |
| 197169 | 12/1982 | Japan | 400/146 |
| 38065 | 3/1984 | Japan | 400/146 |
| 241174 | 10/1986 | Japan | 400/146 |
| 291140 | 12/1986 | Japan | 400/146 |

OTHER PUBLICATIONS

IBM Technical Disclosure Bulletin, vol. 30, No. 6, Nov. 1987, "Print Band Lubrication Method".

IBM Technical Disclosure Bulletin, vol. 27, No. 6, Nov. 1984, "Multi-Function Impact Detector for Impact Printers".

IBM Technical Disclosure Bulletin, vol. 25, No. 7A, Dec. 1982, "Printer Platen For Band Printer".

IBM Technical Disclosure Bulletin, vol. 23, No. 4, Sep. 1980, "Wear Resistant Coating for Platens of Steel Belt Printers".

*Primary Examiner*—Edgar S. Burr
*Assistant Examiner*—Stephen R. Funk
*Attorney, Agent, or Firm*—Michael E. Belk

[57] ABSTRACT

An impact printer has a print band moving longitudinally around pulleys with one side of the band moving in contact along a rigid platen and the other side having engraved characters presented along a print line of a print medium (e.g. paper and ink ribbon). The leading edge of platen is squared off (e.g. sharp) to scrape contamination off the band. A row of hammers impact the print medium against the band between the hammers and an impact surface of the platen. The impact surface of the platen contains multiple longitudinal grooves which start slightly back from the leading edge of the platen and which prevent increased friction force between the band and platen from occurring as the band wears the platen impact surface smooth.

8 Claims, 2 Drawing Sheets

BAND LINE PRINTER WITH GROOVED PLATEN

This is a continuation-in-part of a co-pending application Ser. No. 664,254, filed Mar. 4, 1991, now U.S. Pat. No. 5,168,803, issued Dec. 8, 1992, entitled "Band Line Printer With Grooved Platen," incorporated herein by reference, which discloses a band type line printer with grooves on the surface of the platen.

FIELD OF THE INVENTION

This invention relates to printing apparatus and particularly to impact line printers using an engraved type carrier band.

BACKGROUND OF THE INVENTION

Impact line printers use an endless type-band which is impacted by print hammers arranged in a row. The band is commonly made of metal such as steel on which a row of raised characters and timing marks have been formed on one side. The drive system for revolving the metal band commonly comprises a pair of pulleys one of which is the drive pulley and the other an idler pulley. The band is trained around the pulleys in tension with the reverse side of the band in contact with the pulley to be driven by friction. It is customary to provide a long platen of metal or other hard material behind the band in the areas between the pulleys as a backup to the band. The flat surface of the platen engages the band at all times. The continuous sliding contact of the type band on the platen punctuated by the frequent impacts of the hammer causes the band and platen to wear to the point where one or both must be replaced. Various wear prevention means have been provided to reduce or eliminate the wear. Among these is a wear prevention layer or strip bonded to the face of the platen. Usually the material is one that has low friction properties and is resistant to deformation by impact. One such material used on printers such as the IBM 6262 Printer is a polymer. In such printers it is customary to operate the band drive at speeds of 100–700 inches per second.

In previous impact line printers after a period of time (months or years of operation) motor problems develop. Print quality is reduced and motor overheating may occur resulting in termination of printer operation.

The following publications describe increased friction due to polishing:

1. THE FRICTION AND LUBRICATION OF SOLIDS, Bowden, F. P., Tabor, D., Oxford University Press, 1971, p. 98.
2. "The Influence of Surface Roughness on Wear", Bayer, R. G., Sirico, J. L., WEAR 35 (1975) 251–260.
3. "Effect of Counterface Roughness on the Friction and Wear of Polyethylene Under a Sliding condition Involving Surface Melting", Tanaka, K., Yamada, Y., WEAR OF MATERIALS 1987, The International Conference on Wear of Materials, Houston, Tex., Edited by Ludema, K. C., University of Michigan, Lib. of Congress No. 77 7229.
4. "Tribology of Polymers", Santner, E., Czichos, H., Tribology International, April, 1989, Vol. 22 No. 2, p. 103 to 109.

According to English abstracts Japanese unexamined application Kokai 56-67261 to Fijutsu LTD describes a platen with grooves to reduce the contact area but not in the area opposing the hammers. Japanese unexamined application Kokai 56-67262 to Fijutsu Ltd. describes a groove in a platen opposing to the lower end surface of the type belt to reduce dirt between the belt and platen. U.S. Pat. Nos. 1,200,779 and 2,756,861 show cylindrical platens for typewriters with grooves. U.S. Pat. Nos. 4,510,862 by Alt et al assigned to IBM Corporation and 4,211,166 to Hardt discuss reducing friction between the belt and platen.

SUMMARY OF THE INVENTION

It is an object of the invention to enhance the reliability of line impact printers.

It is another object of the invention to prevent overheating of print band drive motors which may lead to termination of operation.

It is finally an object of this invention to improve print quality of impact printers.

The invention meets these objectives by providing a platen with surface breaks formed in the print hammer impact surface of the platen. In the preferred embodiment, the surface breaks take the form of grooves in the direction of band travel across the entire impact surface length. In addition, the leading edge of the wear strip is a straight edge with a sharply squared configuration for removing contaminants from the belt. The grooves start after the leading edge and extend to the trailing edge of the platen to prevent accumulation of dirt. As a consequence, the frictional drag is reduced and the loading on the band drive motor remains constant and within its tolerable range.

The foregoing as well as other advantages will become readily apparent from the following description of a preferred embodiment of the invention.

DETAILED DESCRIPTION OF THE INVENTION

Figure 1:
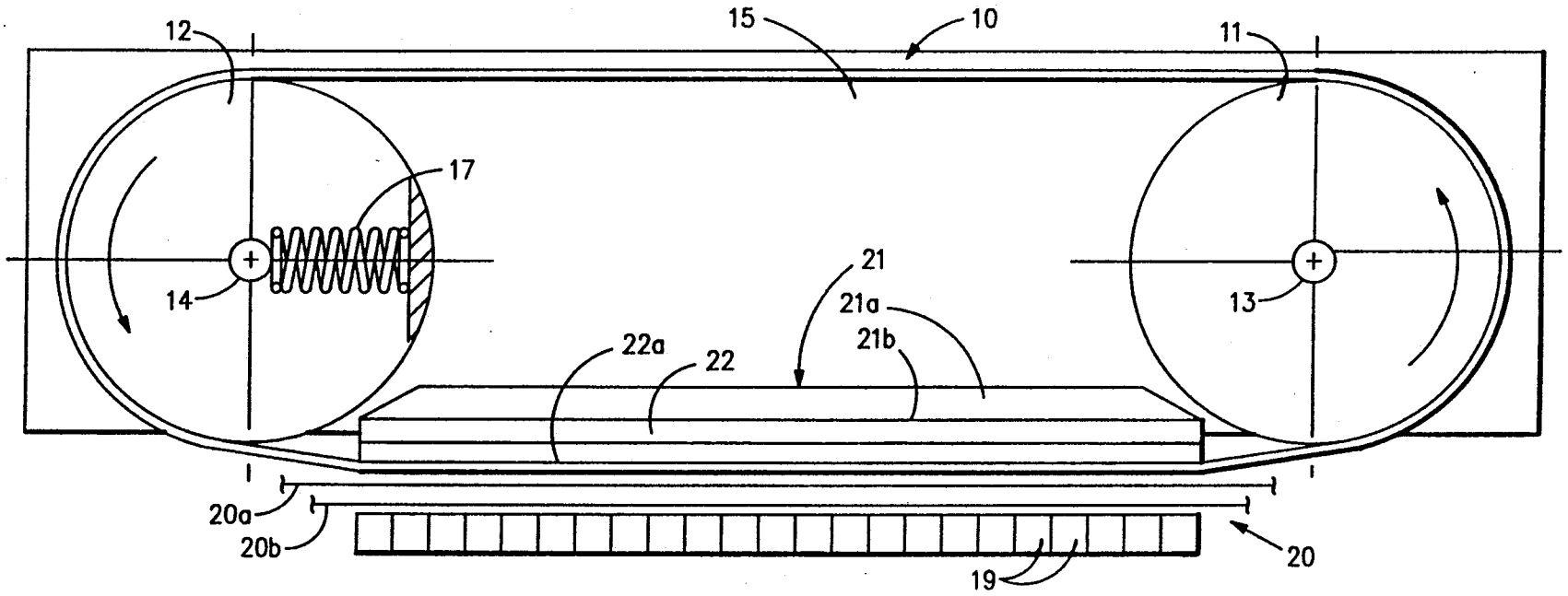
FIG. 1 is a schematic plan view of a printer apparatus in which the invention is incorporated.

Referring to FIG. 1, a printing apparatus comprises flexible endless type-band 10 constructed of, for example, nonferrous steel and having a row of type characters and a parallel row of timing marks (not shown) on the outer face of band 10. Band 10 is trained around a drive pulley 11 and driven or idler pulley 12. Band 10 is driven by friction contact via a motor (not shown) which drives pulley 11. The pulleys are supported by shafts 13 and 14 journaled to casting 15. Spring 17 applies tension to the band in a well-known manner. With this type of band drive there is a relatively long straight section in which printing takes place and in which the band faces the print line. During printing, band 10 is in motion at constant speed and selected hammers 19 are fired toward the band at a time at which a desired character on the band moves past the selected hammer. Between the type band 10 and hammers 19 is arranged print medium 20 such as ink ribbon **20*a* and paper 20*b* on which the characters are printed. As hammers 19 impact print medium 20 against the selected type band character, the hammer and band movement is limited by platen 21 arranged behind band 10 and which generally is a stationary rigid metal plate. In the preferred embodiment, platen 21 takes the form of long, horizontal flange 21***a* extending from one face and at the bottom edge of casting 15 with bottom surface 21*b* parallel to print line. Preferably, wear resistant strip 22 is fixed to and is fully coextensive with bottom surface 21*b* of flange 21*a* and has wear surface 22*a* which bears against the inside surface of band 10. Strip 22 can be any plastic material with good friction and wear properties and capable of withstanding impacts from hammers 19. Preferably strip 22 is a polymer and is fixed to impact surface 21*b* by bonding with an adhesive such as epoxy. For example, VESPEL TM (a trademark of DuPont de Nemours) SP211 with a surface roughness produced by ground finish of 0.25 microns RA is initially installed.

It was determined that the motor problem was due to increased loading of the drive band on the motor. It was discovered that the increased loadings was due to increased frictional drag brought about by polishing of the wear surface caused by wear as a result of sliding engagement between the band and wear surfaces. The problem has been observed at speeds as low as 120 inches per second and even when lubricant such as PTFE is applied to the band or wear surface.

The patentability does not depend upon the theory of operation but, it appears that three conditions occur that increases the band drag. First, the polishing increases the contact surface and with some polymer materials the increase in contact area results in an increase in frictional forces. Secondly, the smoother surface in combination with available fluids (i.e. ink and oil) eliminates atmospheric pressure between the band and were surface, increasing the normal force. Thirdly, the available fluids get between the band and the wear surface and creates viscous drag. This invention of applicant address all three of these potential problems.

Continuous sliding of band 10 on surface 22*a* results in a highly polished wear surface. Motor overheating and band speed variation problems developed after the print band had polished the surface to a finish of about 0.1 microns RA, which was found to produce increased adherence between the band and wear surface 22*a* that is responsible for the excess frictional drag. In addition to overheating the motor, the friction results in print band speed variations which effects print registration and causes unacceptable print quality.

Figure 2:
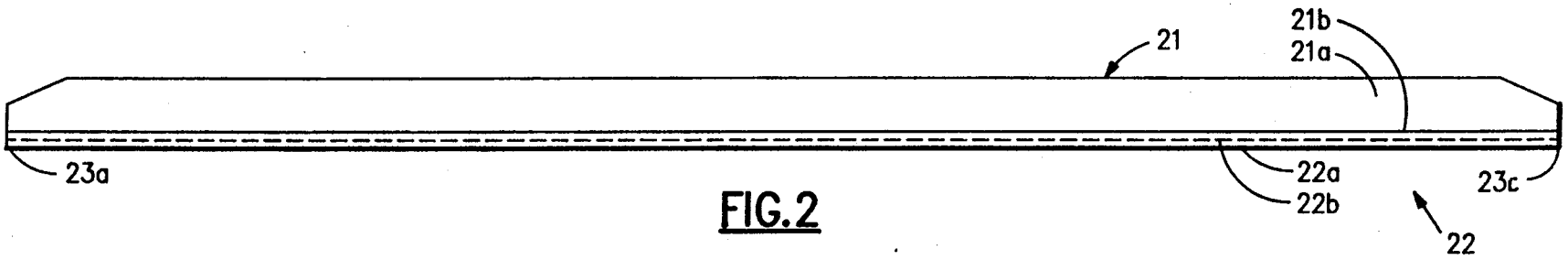
FIG. 2 is an enlarged plan view of only the platen shown in FIG. 1.
Figure 3:
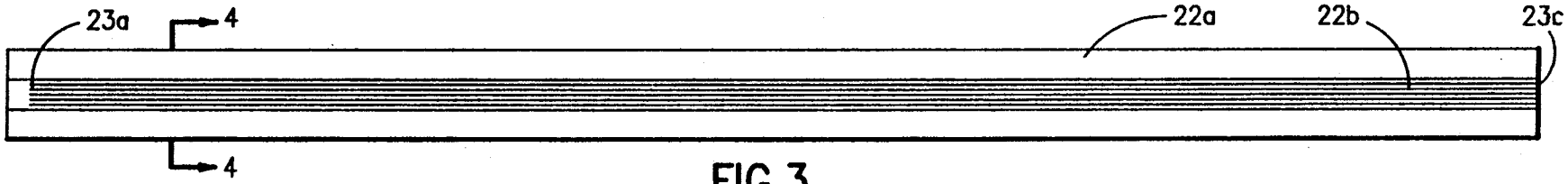
FIG. 3 is a side view of the surface of the platen of FIG. 2 against which the print band rubs.
Figure 4:
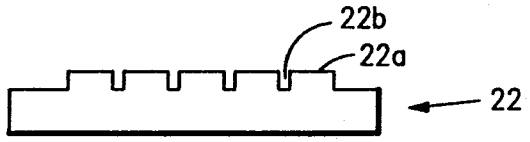
FIG. 4 is a section of the platen of FIG. 3 taken along line 4—4 showing the outline of the grooves.

In accordance with the invention, the frictional drag is reduced to suitable levels by providing breaks 22*b* in wear surface 22*a* as seen in FIGS. 2 and 3. It is especially important that the breaks are placed in the hammer impact area because the impact surface is a major part of the wear surface and the impact contributes to wear. The breaks 22*b* can take various forms, but preferably are grooves which most preferably run parallel to the direction of the print band (i.e. longitudinal) and as shown in FIG. 4, they are preferably of rectangular cross section and are formed during the molding process of strip 22. The grooves start at 23*b* near the sharp, square Lead-in-edge 23*a*, run the length of the platen, and exit at the trailing edge 23*c*. The grooves start after the lead-in-edge to prevent debris (ribbon fabric, dirt, oil, ink, teflon) build-up at the groove entrance.

The position of the grooves is dependent on the placement of the characters on the print band and should be such to prevent separation of the band from the platen during hammer impact. The depth of the grooves should be greater than the expected platen surface wear over the product life. The width and quantity of the grooves was optimized to achieve the longest MTBF (mean time before failure—optimization between higher wear rate resulting from lower surface area and higher drag forces associated from the higher surface area). It was discovered that grooves could be provided in the area of hammer impact without sacrificing print quality. The width of the grooves were minimized to reduce print quality problems and band stress (increases caused by the band deflection). Horizontal grooves proved to be more manufacturable, but other orientations could have been selected.

The square lead-in-edge (23*a*) on the platen wear surface serves as a self cleaning sharp edge to scrape excess debris from the print band. The edge also serves as a mechanism to wipe excess fluid from the print band that would otherwise get between the band and platen wear surface and increase the viscous drag force.

A specific wear strip suitable for practicing the invention was made of VESPEL TM (a Trademark of DuPont de Nemours) sp211 with a surface ground smooth to 0.25 microns RA and with the following dimensions: Width—$\frac{3}{4}$ inches; thickness—0.08 inches; number of grooves—4; width of grooves—0.25 mm; depth of grooves—0.4 mm.

Thus it will be seen that a printer apparatus is provided with an improved platen in a preferred embodiment which solves the problem of excessive frictional drag on the type band and it will be understood by persons skilled in the art that various changes in materials, structure and shape thereof may be made without departing from the invention either in spirit or in scope.

We claim:

1. An impact line printer, comprising:

a print band trained around a drive pulley and an idler pulley and positioned along a print line;

said print band being longitudinally movable around the pulleys in the direction leading along said print line;

a plurality of print hammers mounted for selectively impacting with one surface of the print band along said print line; and a platen having hammer impact surfaces positioned along the print line on an opposite side of the print band from the hammers so that the hammers strike the band against the impact surfaces which become polished as the band slides on the impact surfaces; and including groove means forming elongated breaks in the hammer impact surfaces, the elongated breaks being narrower than the width of each impact surface and into which the band cannot conform, for reducing adherence of the band to the impact surfaces due to the polishing and thereby reducing the frictional drag on said band.

2. The printer of claim 1 in which, a leading edge of the platen is a squared edge for removing contamination from the print band to prevent contamination of the elongated breaks.

3. The printer of claim 1 in which, the groove means include multiple elongated breaks in the hammer impact surfaces of the platen.

4. The printer of claim 3 in which, the elongated breaks are longitudinal along the platen in the direction of movement of the print band and extend through multiple impact surfaces.

5. The printer of claim 4 in which, a leading end of the elongated breaks start after a leading edge of the platen to reduce accumulation of debris.

6. The printer of claim 4 in which, the elongated breaks extend through a trailing edge of the platen, remaining open at the trailing edge to minimize accumulation of contamination in the elongated breaks.

7. The printer of claim 3 in which, a wear surface of polymer material which contains the elongated breaks covers the impact surfaces.

8. The printer of claim 7 in which, a leading edge of the wear surface is a sharply squared edge for removing contamination from the print band; and the elongated breaks in the wear surface are longitudinal in the direction of the movement of the print band and start after a leading edge of the platen and continue through the trailing edge of the platen.

* * * * *